United States Patent [19]

Horgan, Jr.

[11] Patent Number: 4,956,954

[45] Date of Patent: Sep. 18, 1990

[54] DOORWAY SYSTEM FOR GLASS DOORS AND METHOD OF INSTALLATION

[75] Inventor: William J. Horgan, Jr., Pittsburgh, Pa.

[73] Assignee: Blumcraft of Pittsburgh, Pittsburgh, Pa.

[21] Appl. No.: 325,226

[22] Filed: Mar. 17, 1989

[51] Int. Cl.[5] ..... E05D 7/08; E05D 11/06

[52] U.S. Cl. ..... 49/381; 52/204; 52/207; 52/741; 49/384; 49/385; 49/388; 49/397

[58] Field of Search ..... 160/206, 196.1; 52/207, 52/206, 204, 741; 49/371, 385, 388, 390, 397, 384, 381

[56] References Cited

U.S. PATENT DOCUMENTS

| | | | |
|---|---|---|---|
| D. 62,011 | 2/1923 | Weingarten . | |
| D. 106,591 | 10/1937 | Doty et al. . | |
| D. 146,554 | 4/1947 | Butterworth . | |
| D. 218,809 | 9/1970 | Horgan, Jr. . | |
| D. 267,274 | 12/1982 | Horgan, Jr. . | |
| D. 267,275 | 12/1982 | Horgan, Jr. . | |
| D. 289,201 | 4/1987 | Weeden et al. . | |
| 1,724,821 | 8/1929 | Bohnsack . | |
| 2,219,638 | 10/1940 | Erath . | |
| 2,603,825 | 7/1952 | Seaman | 49/388 |
| 3,191,214 | 6/1965 | Protzman | 160/206 |
| 3,267,628 | 8/1966 | Seery . | |
| 3,583,464 | 6/1971 | Johnson | 160/206 |
| 3,827,183 | 8/1974 | Zimmerman | 49/388 |
| 3,964,207 | 6/1976 | Peterson | 49/388 |
| 4,006,569 | 2/1977 | Kain | 52/397 |
| 4,523,414 | 6/1985 | Horgan | 52/235 |
| 4,534,395 | 8/1985 | Carroll | 160/206 |

FOREIGN PATENT DOCUMENTS

| | | | |
|---|---|---|---|
| 174192 | 3/1953 | Austria | 52/207 |
| 2301674 | 9/1976 | France | 49/390 |

*Primary Examiner*—John E. Murtagh
*Attorney, Agent, or Firm*—Paul & Paul

[57] ABSTRACT

A doorway system, comprising a novel mechanism for controlling tall glass doors and making their installation and repair much easier, and a header that can be used with standard size or tall glass doors, is disclosed. The mechanism features circular bearings, a specially-designed bottom spindle and an upper, adjustable, pivotable housing. The header houses, among other parts, the adjustable housing and allows pre-cut, modular parts to be assembled at the building site.

11 Claims, 6 Drawing Sheets

DOORWAY SYSTEM FOR GLASS DOORS AND METHOD OF INSTALLATION

BACKGROUND OF THE INVENTION

This invention relates to a doorway system that allows the use of taller than standard size glass doors and a novel form of header that is used to hold glass doors and sidelight panels in an entranceway. More specifically, the invention relates to glass doors and sidelight panels of a designer's choice of size that are made of glass, or similar materials, and that can be easily erected, inside or outside a building and which allow the doors to be easily moved if repairs are needed.

Architects and building designers are making more and more use of glass doors and sidelights when creating modern buildings. Current design methods attempt to use tall glass doors and sidelights, such as ones that reach from the floor to a twelve-foot high ceiling. Up until the present invention, designers have tended to avoid using glass doors that are taller than the standard eight foot height because of the special construction techniques, and need for ¾ inch glass to provide door stiffness, and hence, extra expense, that would be required. Once the height of a ½ inch thick glass door becomes higher than eight feet, the weight, deflection and physical size of the door become factors that require special consideration in the areas of installation of the door and of making repairs to the closer mechanism or other areas around the door once it has been installed. It is desirable to use ½ inch thick glass because it can be tinted, such as with a bronze or gray color.

Tempered glass of ½ inch thickness weighs approximately 6.56 pounds per square foot and standard doors, of approximately eight foot height by three foot width, weigh about 160 pounds (plus the weight of the hardware used to attach the door). This weight is almost doubled, to about 315 pounds (plus hardware weight), if the door is twelve feet high by four feet wide, and that makes it heavier for the installers to handle and much more awkward to move around during installation. In addition, as the height of the door increases above eight feet, door deflection increases with wind load. Patch fittings that attach the door and transom glass to the sidelight put more strain on the sidelight, thus the sidelights have to be made thicker or glass fins (both of which increase the cost) added to prevent massive deflection of the sidelight under wind-load. Outdoor wind-load design requirements around the United States average 20 pounds per square foot of force and indoor wind-load design requirements average 5 pounds per square foot of force. While the deflection that results from this required wind-load is not necessarily a safety problem, it is an aesthetic problem that detracts from the building's appearance.

It is also known that office building doors use hydraulic door closer mechanisms, such as those made by the Dorma Rixxon and Door-o-Matic Companies, that sit in the floor at the corner of the doorsill to control closing movement of the door. These mechanisms are typically enclosed in a box under the surface of the floor and have only a spindle projecting upward through the door threshold adjacent the door frame. With standard doors, this spindle will bear all of the door weight and it is necessary for the work crew to align the door with the doorway framework at the construction site so that the vertical edge is correctly set over the spindle.

Also, with standard hardware and construction techniques, it is very difficult to make repairs to the door closer mechanism once a tall door is erected over it. Two more factors now become important: how strong are the side panels and transom, for they have to bear the weight of the heavier than normal door, and how strong is the closer mechanism, because it must restrict the closing movement of the heavy door. With the current methods and doorway structure, if any repairs to the closer mechanism become necessary, the complete door must be removed, not just slid back from the edge of the closer and this entails a large amount of effort.

SUMMARY OF THE INVENTION

A novel apparatus for a doorway system and method for installation thereof wherein glass door panels of a multitute of different heights but of a standard thickness are controlled against tension and deflection and door-opening and -closing forces is disclosed. The doorway system employs a rotatable, force-directing and force-transferring spindle-mechanism at the base that bears all weight of the tall glass door, a rotatable tube to tightly hold glass door panels, a pivoting and rotatable spindle and housing to provide regulation forces and a header that is pre-cut with a longitudinally extending slot therein to sealingly contain either, or both, of door panels or sidelight panels adjacent thereto. The doorway system may be used for either interior or exterior doors, in conjunction with standard door closure mechanisms, and is easily installed, maintained and repaired with the use of a slidable, hinged sled that provides sufficient clearance, in cooperation with the bottom spindle-mechanism, to adjust the position of the bottom of the tube, away from the closer mechanism while leaving the top joined to the header and thereby transfer the weight of the door away from said mechanism. The header is advantageously employed, either with tall glass doors or with standard doors, to simplify installation and to increase the flexibility of door position or the position of the sidelights.

OBJECTS OF THE INVENTION

It is therefore an object of the present invention to provide for the use of very tall glass doors at the entranceway to a building.

It is further object of the present invention to provide for the use of very tall glass doors at the entranceway to a building that can be attached to standard door closer mechanisms.

It is a still further object of the present invention to provide a modular header for doorways that can be pre-cut to specified dimensions and assembled at the building.

These and other objects and advantages of the present invention will be readily apparent to those skilled in the art by reading the following brief description of the drawings, detailed description of the preferred embodiment and the appended claims.

DETAILED DESCRIPTION OF THE PREFERRED EMBODIMENT

Figure 1:
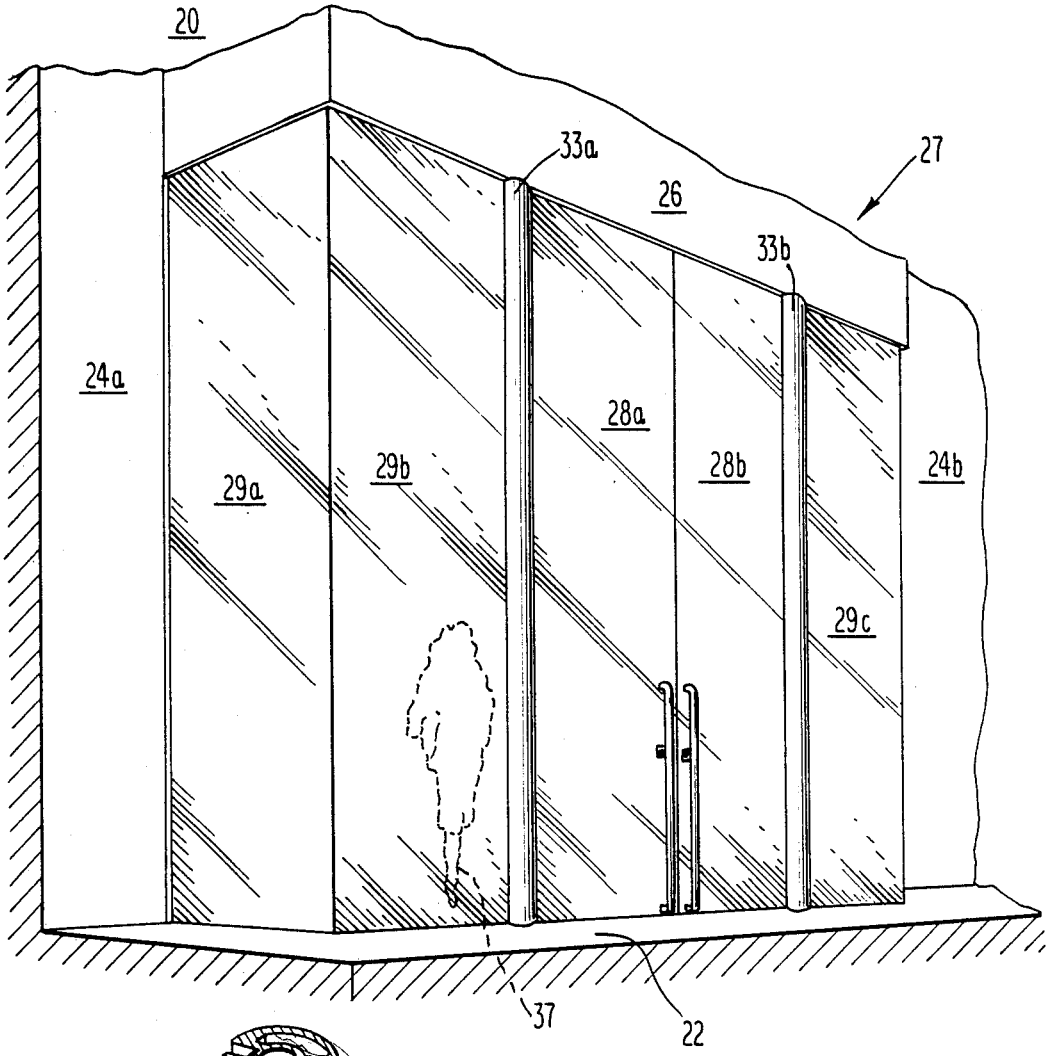
FIG. 1 shows a perspective view of the doorway system of the present invention as it looks installed on a building.

The instant invention provides a solution to the above-identified problems and can be used in or on, among other places, tall office buildings 20 such as shown in fragmentary perspective view in FIG. 1. Building 20 has a floor 22, opposite side walls 24 *a, b* and a front face 26 that can also be a ceiling. FIG. 1 shows that the doorway system 27, according to the present invention, has glass doors 28 *a, b* held by tubular extrusions 33 *a, b* respectively, (made by using known methods) which rotate between modular header 35 and floor 22, header 35 being affixed to face 26, as will be explained. The image of a proportionately-sized person 37 walking out of doorway 27 is shown in phantom through one of the glass panels 29 *a, b* and *c* that are also held in place between header 35 and floor 22.

Figure 2:
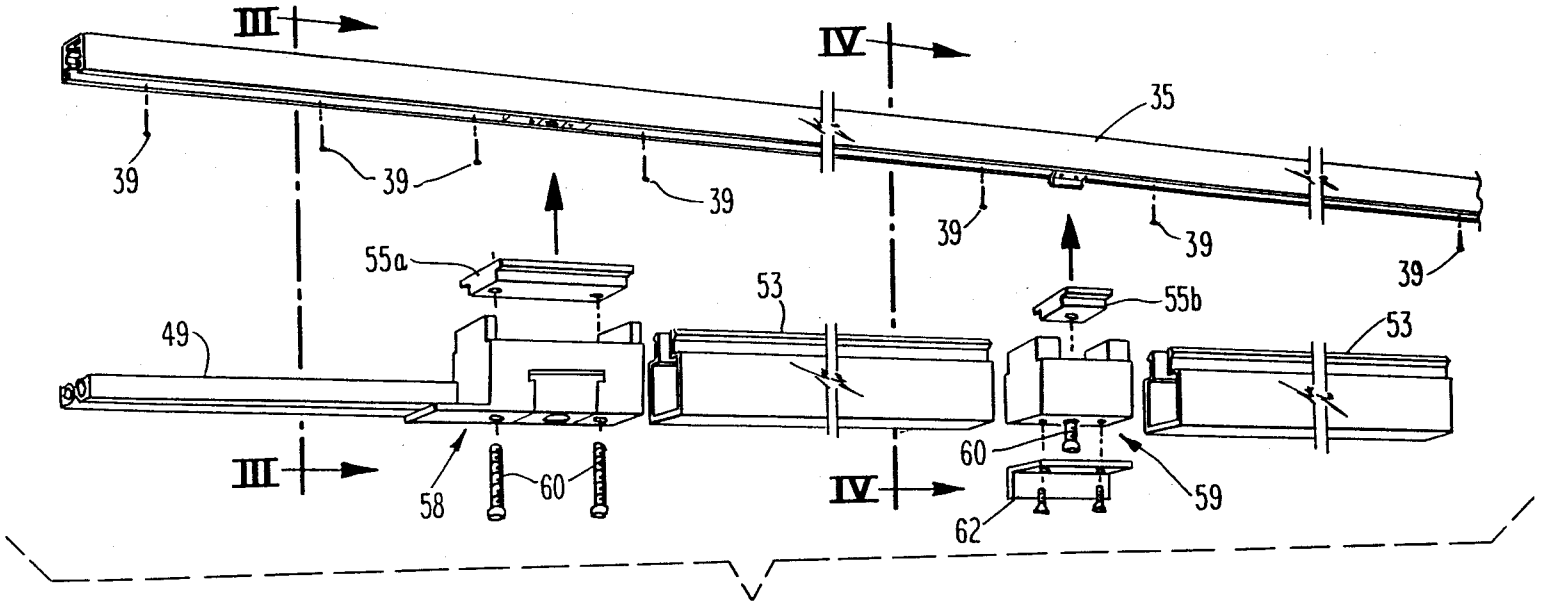
FIG. 2 shows an expanded perspective view of the top of the doorway system.
Figure 4:
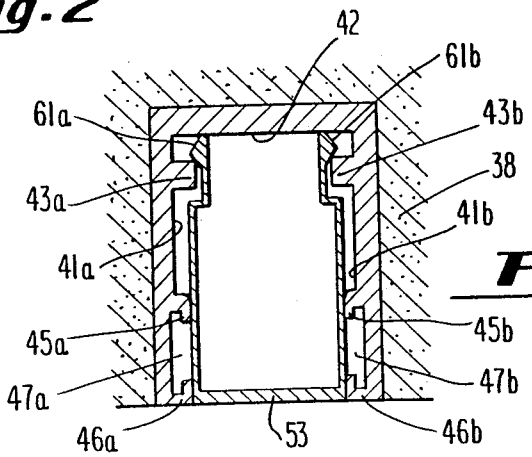
FIG. 4 shows a cross-sectional view of the top of the doorway, in its natural state, taken along lines IV—IV of FIG. 2.
Figure 3:
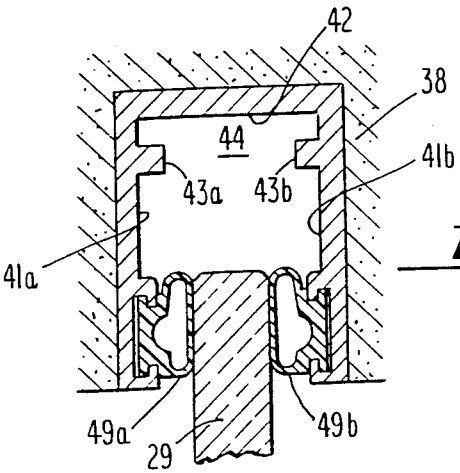
FIG. 3 shows a cross-sectional view of the top of the doorway, in its natural state, taken along lines III—III of FIG. 2.

FIG. 2 shows an expanded, perspective view of the header 35 with various components ready to be installed. FIG. 3 shows a cross-sectional view taken along lines III—III of header 35 in its natural state and FIG. 4 shows a cross-sectional view taken along lines IV—IV of header 35 in its natural state. Header 35 is in the shape of an inverted "U", with several projections extending into the slot down the middle as will be explained. The required length of a section of header 35 can be measured and pre-cut before shipping to the building site for a given installation of doors or sidelight panels, or combination of the two. Header 35 can be attached to the surface of a ceiling (not shown in FIG. 2) or installed in a ceiling 38, such as shown in FIGS. 3 and 4, with nails or screws 39. Header 35 has opposing sidewalls 41*a,b* (shown in FIGS. 2 and 3) connected by central section 42. A projection 43*a,b* extends at approximately 90° from each sidewall to form an opening, or track, 44 adjacent section 42. A pair of right-angle, or "L" shaped projections 45*a,b* and 46*a,b* also extend out from sidewalls 41*a,b,* to form a pair of opposing pockets 47*a,b* (see FIG. 4).

Depending upon the configuration of sidelight panels or doors to be installed at the building, additional components, such as glazing beads 49 or doorway fillers 53, are also pre-cut to be ready for installation. Wherever a door 28 (not shown in FIG. 2) is to be installed, slidable T-nuts 55*a,b* are set into track 44 at pre-determined locations and an adjustable pivot housing 58 or a doorstop housing 59 are attached thereto, as with fasteners 60. A doorstop bracket 62 is fixed onto housing 59 and door fillers 53 are set into the space above the doors between housings 58 and 59 so that ends 61*a,b* are forced into track 44 (as seen in FIG. 4). If a sidelight panel 29 (only partially shown in FIG. 3) is to be installed, glazing beads 49*a,b* are forced into pockets 47*a,b* to firmly hold panel 29 in place.

Figure 5:
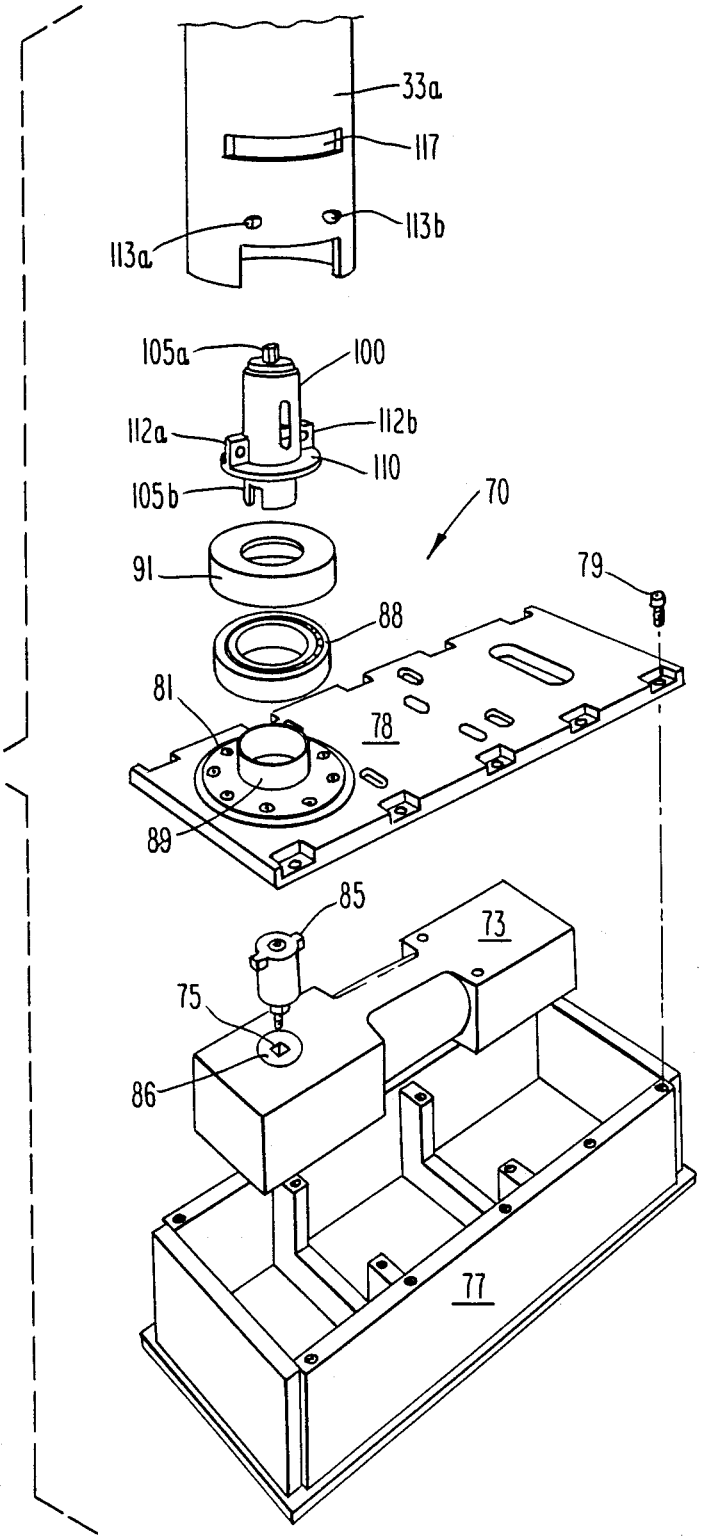
FIG. 5 shows an expanding fragmentary perspective view of the bottom of one corner of the doorway showing the lower operative parts of the door mechanism.

FIG. 5 shows an expanded fragmentary perspective view of the bottom of one corner of the doorway showing the lower operative parts of the door mechanism 70, captured inside of the lower end of extrusions 33, to operate one of doors 28 after a removable sled 150 (not shown in FIG. 5) has been taken away. Mechanism 70 can operate with standard hydraulic door closers 73, that are fitted with a square, or other shape, socket 75 and that are set into foundation 77. Foundation 77 is a rectangular-shaped, boxlike steel cement case that has a removable cover plate 78 attached, as at 79, with a flange 81 securely surrounding an aperture therethrough that is aligned with socket 75. In normal situations, closer 73 is attached to coverplate 78 and the combination then attached to foundation 77; however, this series of attachments could be reversed if necessary.

A spindle 84 with a key 85 is screwed into socket 75 to turn with part 86 of closer 73. If desired, socket 75 can be replaced with a male part, and spindle 84 made with the properly fitted socket (not shown). A circular bearing 88 is set over a bearing retainer 89 which is affixed to flange 81 and a cover 91 placed thereover. Spindle 84 extends from socket 75 up through cover 91 a pre-determined distance. Mechanism 70 has been designed so that all of the weight of the combination of door 28*a* and extrusion 33*a* are carried by bearing 88.

An adjustable engagement bracket assembly 100 with a retractable spindle grip 105*a,b* fits over spindle 84 and grip 105*b* has a slot 107, of equal width and depth as the same dimensions of key 85, that matingly fits over key 85 for a purpose, as will be described. Assembly 100 is connected to a disc-like engagement bracket flange 110 and has a pair of screw flanges 112*a,b* projecting orthogonally from opposite sides thereof and flange 110 along opposite radials from one another. Screw flanges 112 *a, b* are conveniently used to make slight, or fine, adjustments to the relation of the door in the doorway. The bottom end of tubular extrusion 33*a* has an inner diameter large enough to fittingly surround assembly 100 so that screws 114*a,b* (not shown in FIG. 5) securely bind extrusion 33*a,* via apertures 113*a,b,* to screw flanges 112*a,b* and spindle grip 105*a* can be accessed through clearance slot 117, as will be explained.

Figure 6:
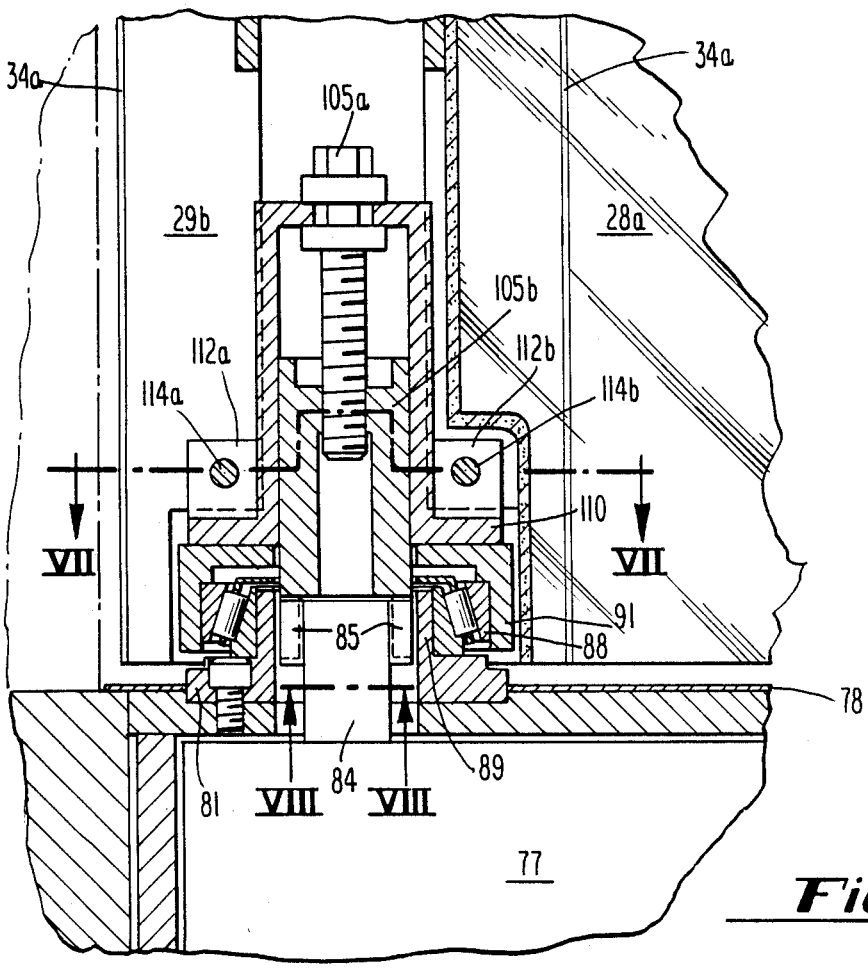
FIG. 6 shows a fragmentary elevational view of the lower operative parts of the door mechanism.
Figure 7:
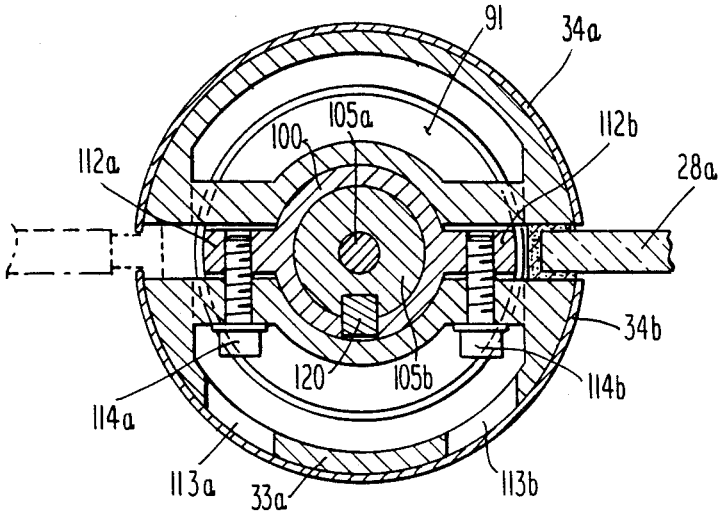
FIG. 7 shows a cross-sectional view of the lower operative parts of the door mechanism taken along lines VII—VII of FIG. 6.
Figure 8:
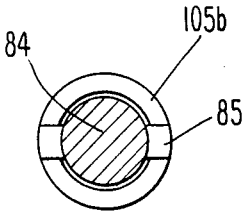
FIG. 8 shows a cross-sectional view of the closer spindle of the door mechanism taken along lines VIII—VIII of FIG. 6.

As seen in FIG. 6, a fragmentary elevational view of the operative parts of the bottom of extrusion 33*a,* spindle grip 105*a* is threadingly engaged inside of grip 105*b*. Turning grip 105*a* in one direction causes grip 105*b* to be lowered so that slot 107 mates with key 85 and turning it in the opposite direction causes it to be raised up a sufficient distance to clear key 85. Bracket flange 110 rests upon cover 91 and holds all of the weight of extrusion 33*a* and glass panel 28*a* so that floor closer 73 does not bear any weight at all and is only responsible for providing rotational motion through a vertical axis (not shown) that extends up from socket 75. As door 28*a* and extrusion 33*a* rotate, a pin guide 120 prevents grip 105 from rotating.

Figure 10:
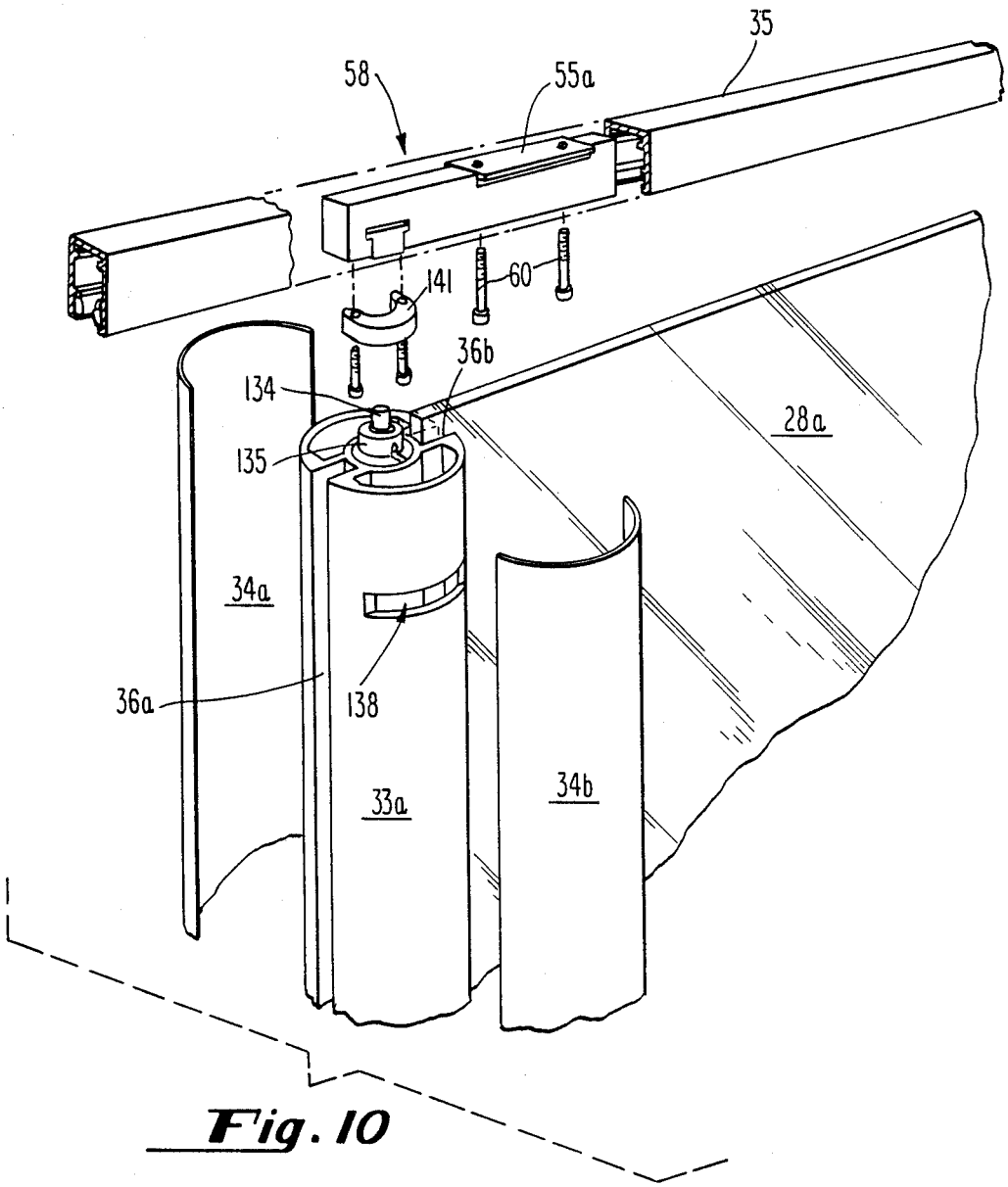
FIG. 10 shows an expanded fragmentary perspective view of the top of one corner of the doorway showing the upper operative parts of the door mechanism and the header that is used at the ceiling to attach doors to the building.
Figure 11:
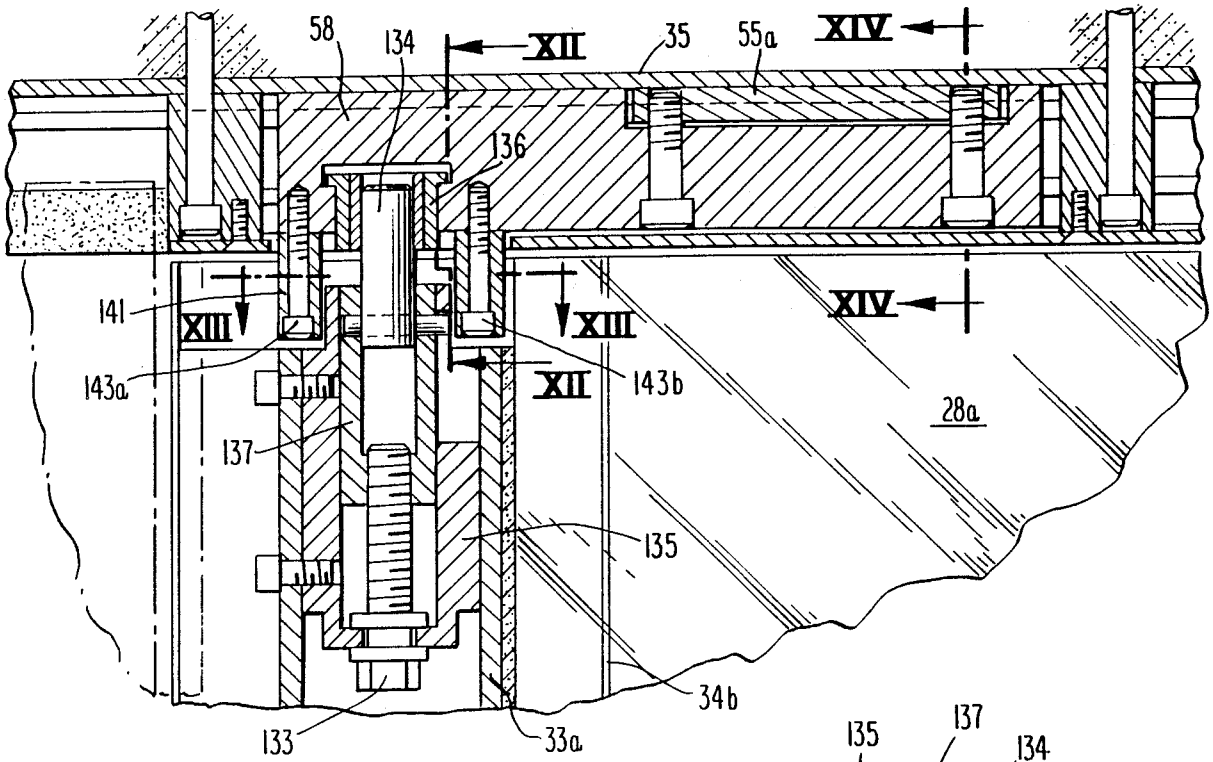
FIG. 11 shows a fragmentary elevational view of the header and the operative parts at the top corner of the doorway.
Figure 13:
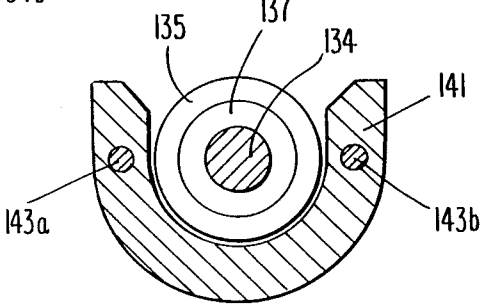
FIG. 13 shows a cross-sectional side view of the pivoting mechanism of the doorway taken along lines XIII—XIII of FIG. 11.
Figure 12:
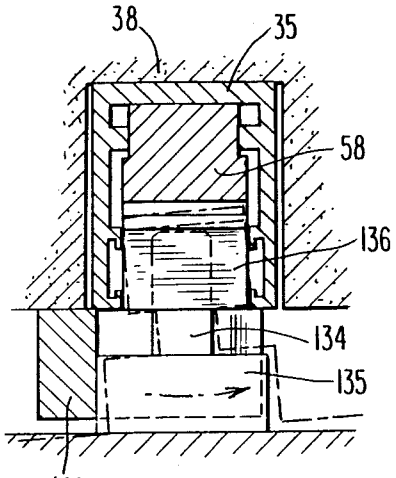
FIG. 12 shows a cross-sectional view of the pivotable spindle of the top of the doorway taken along lines XII—XII of FIG. 11.
Figure 14:
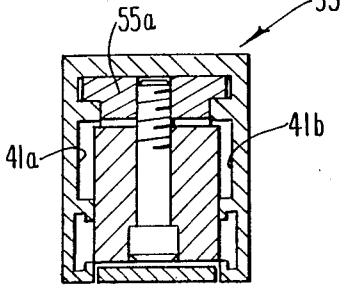
FIG. 14 shows a cross-sectional sideview of the header taken along lines XIV—XIV of FIG. 11.

FIG. 10 shows an expanded fragmentary perspective view of the top end of extrusion 33*a* and showing tube covers 34*a,b* as they form a shell around extrusion 33*a*. Extrusion 33*a* conveniently has slots 36*a,b* down the entire length, each of which can securely grip a panel, such as 28*a*. FIG. 11 shows a fragmentary elevational view of the header and the operative parts at the top corner of the doorway. The top of the doorway employs a device very similar to the bottom in that upper pivot housing 135 with a retractable pivot 134 threadedly set therein and a pivot block 136 are rotatingly and pivotally inserted into housing 58 and a bolt 133, accessed through slot 138, can be turned to raise or lower pivot 134 which is connected thereto by intermediate segment 137. Extrusion 33*a*, which can conveniently be made with different longitudinal configurations, and pivot flange 131 surrounding pivot 134 are initially slipped into the recess 139 in housing 58 with the use of horseshoe-shaped collar 141. A pair of screws 143*a,b* are used to initially secure collar 141 and pivot 134 inside housing 58 and pivot 134 then self-centers therein. A slightly larger size opening in the ceiling 38 (see FIG. 12) allows the sides 41*a,b* of header 35 to deform as pivot 134 rocks back and forth.

Figure 9:
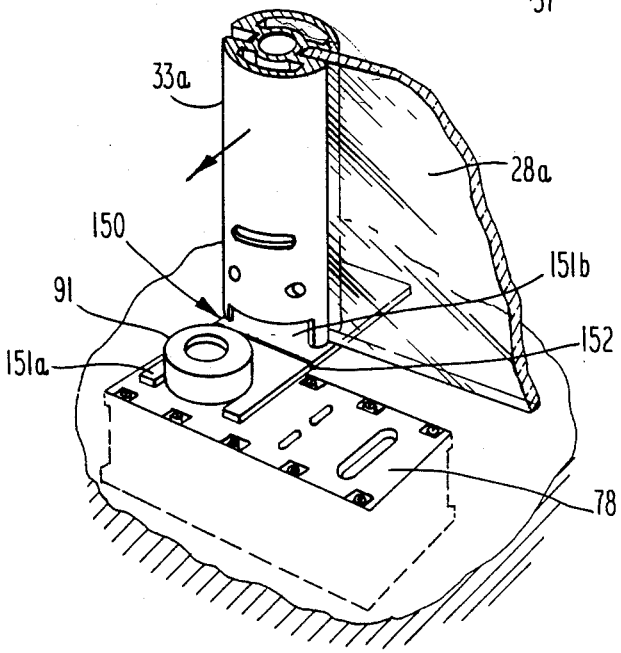
FIG. 9 shows a fragmentary perspective view of a door employing the current invention being fitted (as shown by the arrow) over the bearing housing.

FIG. 9 shows a fragmentary perspective view of the bottom corner of a door that employs the current invention being erected (as shown by the arrow). A sled 150 having a substantially U-shaped front section 151*a* hingedly joined as at hinge 152, to rear section 151*b* is used to slide the bottom of extrusion 33*a* over cover 91, and then removed. Spindle 105*a* is turned until slot 107 fits over key 85. As mentioned, collar 141 is fitted around pivot flange 131 and pushed into recess 139 in housing 58. Once screws 143*a,b* are fastened into housing 58 and bolt 133 is rotated to push pivot 134 to its highest, the door is operable.

If repairs to door closer 73 are required, spindle 105*a* is turned in the opposite direction to retract, and raise, assembly 100. Sled 150 is reinserted under extrusion 33*a* and it and door 28*a*, and all of the combined weight, are moved back away from the cover 78 of foundation 77, to allow access thereto by flipping up front section 151*a*. Because of the amount of space surrounding header 35, pivot block 136 is able to tilt (as shown in phantom in FIG. 12), thus allowing the top of extrusion 33*a* to remain in its rotatable position and extrustion 33*a* and panel 28*a* to remain in a substantially vertical position. This procedure is reversed to re-install the door. These and other variations in the details of the system may be made in accordance with the invention, which is to be broadly construed and to be defined by the scope of the claims appended hereto.

I claim:

1. A header system for a building which includes a floor and a ceiling and a door or a panel extending therebetween comprising:

a channel attached to the ceiling, said channel having a longitudinally extending slot therethrough with opposed inner side walls jointed by a center wall; at least one first projection of pre-determined size extending from each side wall opposite one another and adjacent said center wall to form a track therebetween; and at least two right-angular projections extending from each said side walls with the right angles facing one another to form a pocket-area spaced apart from said track and adjacent each said side wall; wherein filler means comprising a slidable and lockable platform, having at least one aperture therethrough, and being movable in said track is held between said walls and stop means is attached to a face of said filler means to halt door rotation.

2. A header system as described in claim 1 wherein filler means comprising a slidable and lockable platform, having at least one aperture therethrough and movable in said track, is held between said walls and pivotable housing means is attached to a face of said filler means to rotatably and pivotally accept a door spindle projecting therein such that a door is rotatably held between the floor and the header.

3. A header system as described in claim 1 wherein filler means comprising a substantially U-shaped insert having opposing side legs with a centrally-located connecting section substantially equal in width to the distance between said opposed right-angular projections is held between said inner walls with hooking means at the ends of said side legs opposite from said section, attached in said track.

4. A header system as described in claim 1 wherein a panel extends from adjacent the floor into said channel and filler means comprising sealing means extending from opposite said pocket-area securely holds an edge of the panel.

5. A doorway system, for a building which includes a ceiling and a floor having a door closer mechanism therein, comprising:

channel means attached to the ceiling to define the boundary of the doorway and containing an adjustable and pivoting housing means; and tube means fixedly holding a panel of glass with a top end inserted inside said housing means and a bottom end removably connectable to the door closer mechanism, said tube means forming a vertical axis between said housing means and the door closer mechanism, and being rotatable about the vertical axis, and pivotable at said housing means when said bottom end is removed from the door closer mechanism.

6. A doorway system as described in claim 5 wherein said tube means comprises spindle means adjustably and removably attached to the door closer to pivotally transfer movement of said closer to said panel;

bearing means situated co-axially adjacent with said spindle means to support said panel and re-distribute the weight of said panel away from a doorway closer; and adjustable bracket means removably attached to said spindle means and supported by said bearing means to transfer movement of said panel.

7. A doorway system as described in claim 5 wherein said tube means includes a tubular shaped extrusion having at least one longitudinally extending slot therein for sealingly holding a panel of glass.

8. A doorway system as described in claim 7 wherein said channel means has a slot therethrough with opposed inner side walls joined by a center wall.

9. A doorway system, for a building which includes a ceiling and a floor having a door closer mechanism therein, comprising:

a channel attached to the ceiling, said channel having a longitudinally extending slot therethrough with opposed inner side walls joined by a center wall;

at least one first projection of predetermined size extending from each said side wall opposite one another and adjacent said center wall to form a track therebetween;

at least two right-angular projections extending from each said side walls with the right angles facing one another to form a pocket-area spaced apart from said track and adjacent each said side wall;

filler means, comprising a slidable and lockable platform having at least one aperture therethrough and movable in said track, held between said walls and pivotable housing means attached to a face of said filler means to rotatably and pivotally accept a door spindle projecting therein; an d tube means fixedly holding a panel of glass with a top end inserted inside said housing means and a bottom end removably connectable to the door closer mechanism, said tube means forming a vertical axis between said housing means and the door closer mechanism, and being rotatable about the vertical axis, and pivotable at said housing means when said bottom end is removed from the door closer mechanism.

10. A doorway system as described in claim 9 wherein said channel means contains movable and adjustable receptacle means for fixing the top of said tube means at a predetermined location.

11. A method for installing a glass door in the doorway of a building having a floor closer mechanism therein including the steps of:

(a) attaching channel means to the ceiling of the doorway to define the boundary of the doorway, said channel means containing at least one movable pivot housing;

(b) providing tube means with top and bottom ends to sealingly hold a panel of glass, said tube means containing at its top end a semi-circular collar surrounding a pivot spindle to allow pivoting and rotational movement therein and at its bottom end spindle means for removable attachment to the floor closer mechanism;

(c) attaching said collar and spindle inside said pivot housing; and (d) removably attaching said spindle means to the floor closer mechanism.

* * * * *

UNITED STATES PATENT AND TRADEMARK OFFICE

CERTIFICATE OF CORRECTION

PATENT NO. : 4,956,954

DATED : September 18, 1990

INVENTOR(S) : William J. Horgan, Jr.

It is certified that error appears in the above-identified patent and that said Letters Patent is hereby corrected as shown below:

Column 6, line 3, "jointed" should be -- joined --.

Signed and Sealed this

Tenth Day of March, 1992

*Attest:*

HARRY F. MANBECK, JR.

*Attesting Officer*

*Commissioner of Patents and Trademarks*